US011433679B2

(12) United States Patent
Oya

(10) Patent No.: US 11,433,679 B2
(45) Date of Patent: Sep. 6, 2022

(54) CARTRIDGE AND PRINTING DEVICE

(71) Applicant: SEIKO EPSON CORPORATION, Tokyo (JP)

(72) Inventor: Shun Oya, Kiso-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 91 days.

(21) Appl. No.: 17/105,865

(22) Filed: Nov. 27, 2020

(65) Prior Publication Data

US 2021/0162765 A1 Jun. 3, 2021

(30) Foreign Application Priority Data

Nov. 29, 2019 (JP) ..... JP2019-216446

(51) Int. Cl.
*B41J 2/175* (2006.01)

(52) U.S. Cl.
CPC ..... *B41J 2/1753* (2013.01); *B41J 2/17553* (2013.01)

(58) Field of Classification Search
CPC .... B41J 2/1753; B41J 2/17553; B41J 2/1752; B41J 2/17513
USPC ..... 347/86
See application file for complete search history.

(56) References Cited

U.S. PATENT DOCUMENTS

2009/0096850 A1* 4/2009 Sulser ..... B41J 2/17513 347/86
2013/0182048 A1* 7/2013 Nozawa ..... B41J 2/17553 347/86
2015/0165773 A1* 6/2015 Shiota ..... B41J 2/17523 347/85
2020/0282729 A1 9/2020 Inoue et al.

FOREIGN PATENT DOCUMENTS

JP 2019-073014 A 5/2019

* cited by examiner

*Primary Examiner* — Kristal Feggins
*Assistant Examiner* — Alexander D Shenderov
(74) *Attorney, Agent, or Firm* — Oliff PLC

(57) ABSTRACT

A cartridge is configured to be moved in a −Y direction and then rotated in an intersecting direction intersecting with a Y direction in an installation process of installing the cartridge in a printing device including a device terminal holder holding device terminals and having first and second positioning portions. The cartridge includes cartridge terminals and a cartridge terminal mounting portion disposed on a case and has the cartridge terminals thereon in a movable manner in the Y direction and a rotation radial direction relative to the case. The cartridge terminal mounting portion includes a restricting portion configured to restrict the movement of the cartridge terminals in the Y and Z directions during the installation process. The restricting portion includes first and second restricting portions located at respective ends in the +Y and −Y directions of the cartridge terminal mounting portion and being in contact with the respective first.

11 Claims, 9 Drawing Sheets

CARTRIDGE AND PRINTING DEVICE

The present application is based on, and claims priority from JP Application Serial Number 2019-216446, filed Nov. 29, 2019, the disclosure of which is hereby incorporated by reference herein in its entirety.

BACKGROUND

1. Technical Field

The present disclosure relates to a cartridge and a printing device.

2. Related Art

JP-A-2019-73014 describes a cartridge to be attached to an installation portion having multiple electrical connection portions. In JP-A-2019-73014, the cartridge is moved in an insertion direction and inserted into the installation portion and multiple electrodes of the cartridge are moved in a direction different from the insertion direction to be electrically coupled to the electrical connection portions. This technology reduces the impact on the electrodes and the electrical connection portions in the coupling process.

In the configuration described in JP-A-2019-73014, the cartridge is movable relative to the installation portion in the insertion direction and a direction different from the insertion direction. In this configuration, the accuracy of coupling positions between the electrodes and the electrical connection portions may be low.

SUMMARY

According to an aspect of the present disclosure, a cartridge is provided. The cartridge is configured to be moved in a −Y direction and then rotated in an intersecting direction intersecting with a Y direction in order to be installed in a printing device that includes a plurality of device terminals and a device terminal holder holding the plurality of device terminals and having first and second positioning portions, in which three perpendicular spatial axes are X, Y, and Z axes, directions along the X, Y, and Z axes are, respectively, X, Y, and Z directions, positive directions along the X, Y, and Z axes are, respectively, +X, +Y, and +Z directions, and negative directions along the X, Y, and Z axes are, respectively, −X, −Y, and −Z directions. The cartridge includes a case containing a print material, a plurality of cartridge terminals configured to be electrically coupled to the plurality of device terminals, and a cartridge terminal mounting portion disposed on the case and having the plurality of cartridge terminals thereon. The plurality of cartridge terminals is configured to be moved relative to the case in the Y direction and a rotation radial direction of the rotation. The cartridge terminal mounting portion includes a restricting portion configured to restrict movement of the cartridge terminals in the Y direction and the Z direction during an installation process of installing the cartridge in the printing device, and the restricting portion includes a first restricting portion located at an end in the −Y direction of the cartridge terminal mounting portion and configured to be in contact with the first positioning portion in the installation process and a second restricting portion located at an end in the +Y direction of the cartridge terminal mounting portion and configured to be in contact with the second positioning portion in the installation process.

DESCRIPTION OF EXEMPLARY EMBODIMENTS

A. First Embodiment

Figure 1:
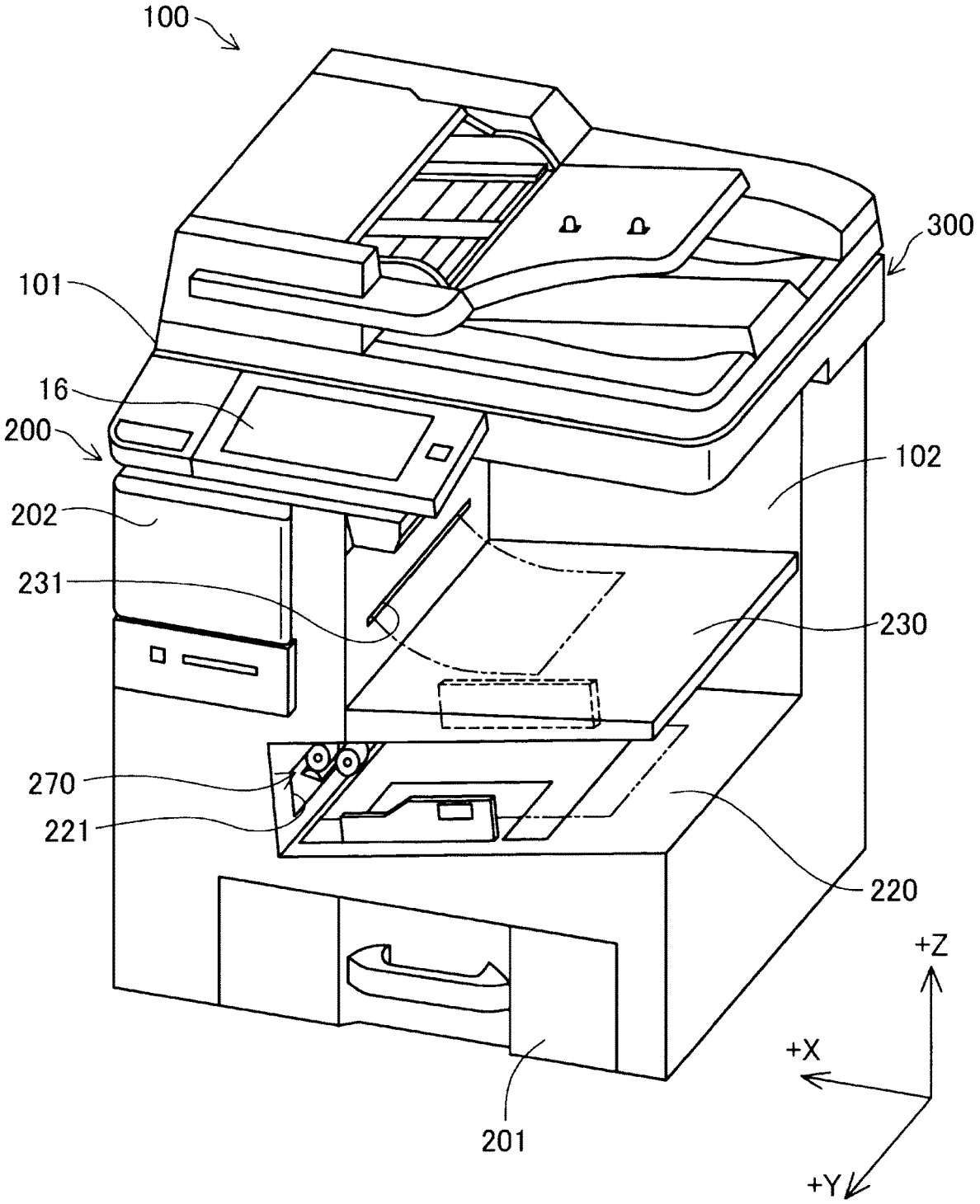
FIG. 1 is a schematic perspective view illustrating a multi-function device.

FIG. 1 is a schematic perspective view illustrating a multi-function device 100 according to a present embodiment. In FIG. 1, perpendicular arrows directed in the X, Y, and Z directions are indicated. The X, Y, and Z directions extend, respectively, along the X, Y, and Z axes, which are three perpendicular spatial axes, and each extend in two opposite directions along the X, Y, and Z axes. Specifically described, positive directions along the X, Y, and Z axes are, respectively, a +X direction, a +Y direction, and a +Z direction, and negative directions along the X, Y, and Z axes are, respectively, a −X direction, a −Y direction, and a −Z direction. In FIG. 1, the X and Y axes extend horizontally, and the Z direction extends vertically. In this embodiment, the −Z direction corresponds to a gravity direction. In the other drawings, the arrows directed in the X, Y, and Z directions are indicated, as necessary. The X, Y, and Z directions in FIG. 1 correspond to the X, Y, and Z directions in the other drawings.

The multi-function device 100 includes a printing device 200, which prints on media such as paper, and a reader 300, which reads characters and images on media as image data. The multi-function device 100 performs various printing tasks and reading tasks by using at least one of the printing device 200 and the reader 300. The multi-function device 100 has print functionality and read functionality.

In this embodiment, the reader 300 and the printing device 200 on the reader 300 constitute a body 101. The body 101 has a cuboidal overall shape. The body 101 has a front surface, a rear surface, a left surface, a right surface, an upper surface, and a bottom surface. In this embodiment, the front surface of the body 101 faces in the +Y direction and the upper surface thereof faces in the +Z direction.

The body 101 has a recess 102. Specifically described, the printing device 200 has the recess 102 and the recess 102 opens in the −X direction, +Y direction, and +Z direction in the printing device 200. The reader 300 covers the opening of the recess 102 facing in the +Z direction. In other words, the recess 102 opens in the front surface and the left surface of the body 101.

The multi-function device 100 includes an operation panel 16 at an outer front surface of the body 101. A user can cause the multi-function device 100 to execute printing and reading tasks through the operation panel 16.

The reader 300 includes an auto document feeder (ADF) and a flatbed scanner (FBS) and can read a document automatically fed by the ADF and a document placed on the FBS. The reader 300 may be referred to as a "scanner".

The printing device 200 is in the form of an ink jet printing device that ejects ink as a print material to print an image on a medium. The printing device 200 converts image data sent from, for example, a computer (not illustrated) and image data read by the reader 300 into dot on/off print data on a print medium. The printing device 200 ejects ink onto the print medium in accordance with the print data to form dots at various positions of the print medium. Thus, an image is printed on the print medium. The printing device 200 may be referred to as a "printer".

The printing device 200 includes a detachable cassette 201 that houses media. Specifically described, the cassette 201 is located near the bottom of the printing device 200 and is detachable in the Y direction. The cassette 201 houses a stack of sheets of paper as media. A medium is fed from the cassette when a recording operation is performed. The printing device 200 of this embodiment may include another cassette that houses media below the cassette 201. The medium is not limited to a sheet of paper and may be any sheet that can hold a print material. Examples of the medium include a plastic sheet, a film sheet, a fiber sheet, a cloth sheet, a leather sheet, a metal sheet, a glass sheet, a wooden sheet, and a ceramic sheet.

The printing device 200 of this embodiment includes an input tray 220 and an output tray 230 in the recess 102. Media before printing are placed on the input tray 220. Media after printing are placed on the output tray 230. Specifically described, the input tray 220 is the bottom surface of the recess 102. The output tray 230 is a plate that divides the recess 102 in the Z direction. The medium on the input tray 220 is sent to the inside of the printing device 200 through an input opening 221 facing the input tray 220. The medium after printing is sent from the inside of the printing device 200 to the output tray 230 through an output opening 231 facing the output tray 230.

Figure 2:
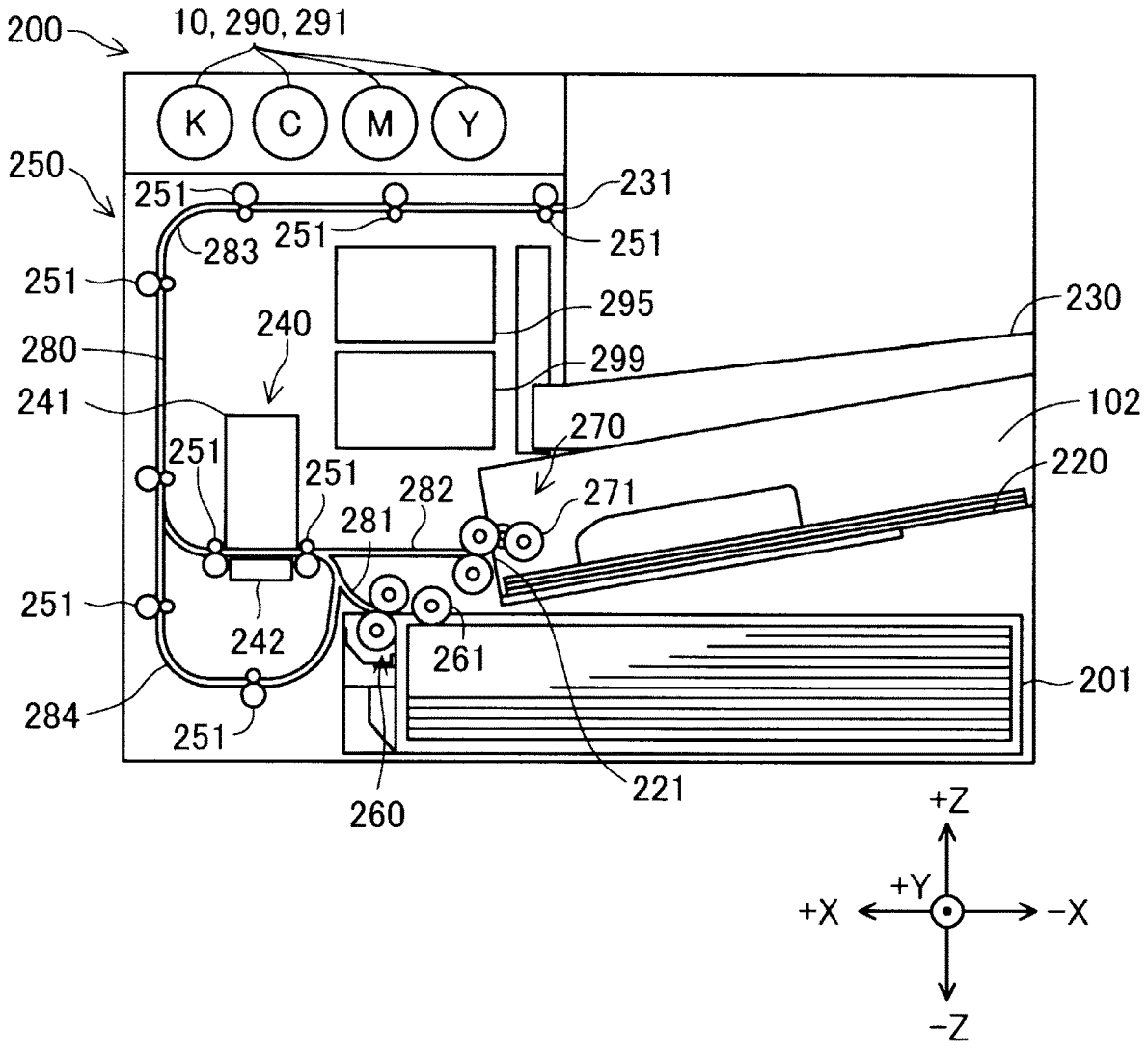
FIG. 2 schematically illustrates an internal structure of a printing device.

FIG. 2 schematically illustrates the internal structure of the printing device 200. FIG. 2 illustrates a recording unit 240, a transportation mechanism 250, installation portions 290, a print material supply portion 295, and a maintenance portion 299 of the printing device 200.

The transportation mechanism 250 includes a first roller unit 260, a second roller unit 270, multiple transportation rollers 251, and a transportation guide 280.

The transportation guide 280 holds and transports a medium. The transportation guide 280 of this embodiment is a belt-like component that uses electrostatic adsorption to hold and transport a medium. The transportation guide 280 is moved by rotation of the transportation rollers 251 and transports the medium while holding the medium. The direction in which the medium is transported may be referred to as a transportation direction.

The transportation guide 280 includes a first guide 281, a second guide 282, a third guide 283, and a fourth guide 284. The first guide 281 sends a medium from the cassette 201 toward the recording unit 240. The second guide 282 sends a medium from the input tray 220 toward the recording unit 240. The third guide 283 sends a medium from the recording unit 240 toward the output opening 231. The fourth guide 284 sends a medium from the output opening 231 toward the recording unit 240. The recording unit 240 is located at the middle of the transportation guide 280. The fourth guide 284 is used when a medium that has been subjected to printing on one side is subjected to printing on the other side.

The first roller unit 260 sends a medium in the cassette 201 toward the first guide 281. When a medium in the cassette 201 is used for a printing task, the medium in the cassette 201 is pressed against a first pickup roller 261 of the first roller unit 260 from below in the vertical direction. The first pickup roller 261 applies a rotational force to the pressed medium to pick up the medium. The medium picked up is sent to the first guide 281 by rollers of the first roller unit 260.

The second roller unit 270 sends a medium on the input tray 220 toward the second guide 282. When a medium on the input tray 220 is used for a printing task, the medium on the input tray 220 is pressed against a second pickup roller 271 of the second roller unit 270 from below in the vertical direction. The second pickup roller 271 applies a rotational force to the pressed medium to pick up the medium. The medium picked up is sent to the second guide 282 by rollers of the second roller unit 270.

The recording unit 240 includes a recording head 241 and a platen 242. The recoding head 241 is a full-line head and has discharge openings through which ink is ejected in accordance with the print data. The discharge openings are arranged in the Y direction over the entire width of the recording medium. The platen 242 has a plate-like shape and extends in the Y direction. The platen 242 supports the medium to be printed by the recoding head 241 from below. The recording head 241 is not limited to a full-line recording head and may be a serial scan head that reciprocates in a direction intersecting with the transportation direction of the recording medium.

The installation portion 290 receives a cartridge 10 that contains a print material. Specifically described, the installation portion 290 has an installation hole 291 extending in the Y direction of the printing device 200. The installation hole 291 of this embodiment has a substantially cylindrical shape. The installation hole 291 has an opening in the front surface of the printing device 200. The cartridge 10 is attached to the installation portion 290 when inserted into the installation hole 291 from the front surface of the printing device 200. In this embodiment, the printing device 200 has four installation portions 290, and four cartridges 10 containing different colors of ink are attached to the installation portions 290. As illustrated in FIG. 1, the installation portions 290 are covered by a cover 202 when the printing device 200 is in a printing operation. The installation portion 290 and the cartridge 10 are described in detail later.

The print material supply portion 295 supplies ink as a print material in the cartridges 10 to the recording unit 240 and adjusts the pressure and amount of ink in the recording head 241. The print material supply portion 295 is located at the middle of an ink tube (not illustrated) that couples the cartridges 10 to the recording unit 240. As described above, the ink supplied to the recording unit 240 is ejected through the discharge openings of the recording unit 240 toward a medium.

The maintenance portion 299 includes a cap unit and a wiping unit (not illustrated). The maintenance portion 299 cleans the recording head 241 to reduce clogging of the discharge openings of the recording head 241, for example. The maintenance portion 299 carries out the maintenance of the recording head 241 when a user inputs maintenance instructions through the operation panel 16 or at a predetermined time in the printing operation.

Figure 3:
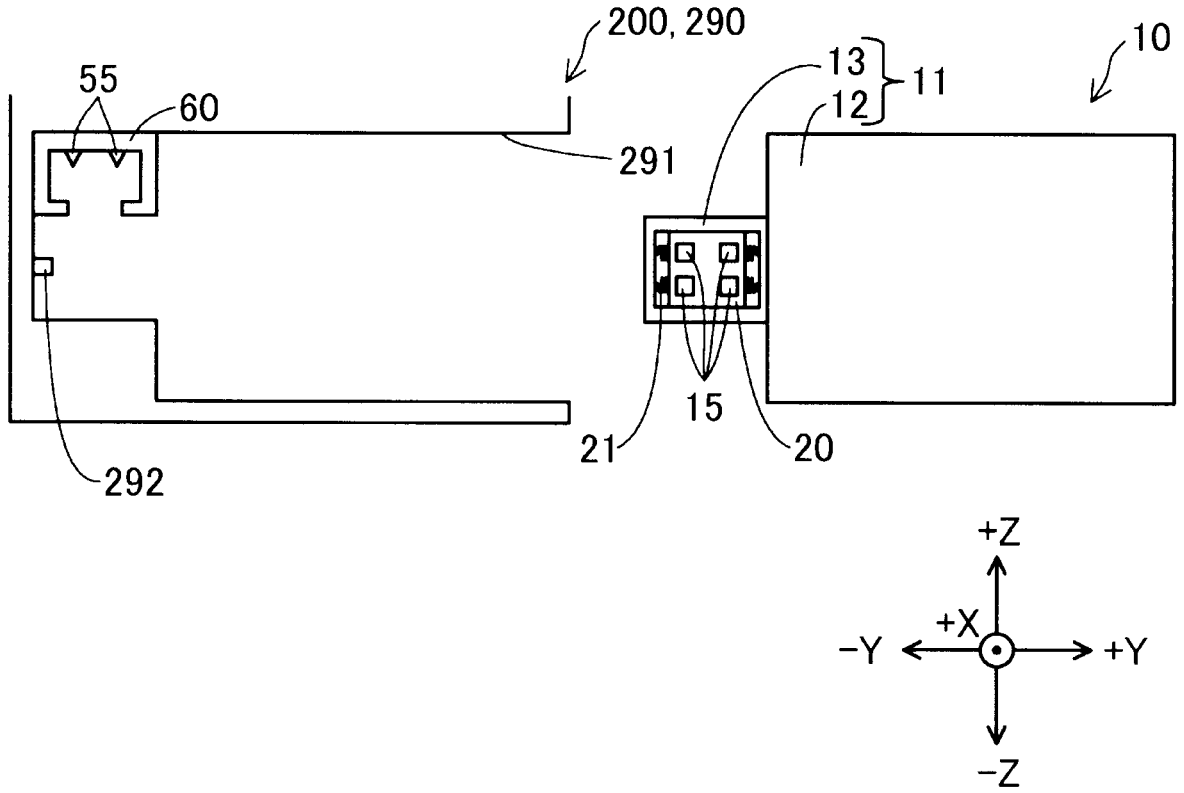
FIG. 3 is an explanatory view schematically illustrating an installation portion and a cartridge.

FIG. 3 is a schematic explanatory view illustrating the installation portion 290 and the cartridge 10. In FIG. 3, one of the installation portions 290 and one of the cartridges 10 corresponding to the installation portion 290 are illustrated.

As illustrated in FIG. 3, the installation portion 290 has multiple device terminals 55 and a device terminal holder 60. The installation portion 290 of this embodiment further includes a supply tube 292. The device terminals 55 are terminals electrically coupled to cartridge terminals 15 of the cartridge 10. The device terminal holder 60 holds the device terminals 55. The supply tube 292 is a tube that guides the ink in the cartridge 10 to the inside of the printing device 200.

In this embodiment, the device terminals 55 face in the −Z direction in the device terminal holder 60. In other words, the cartridge terminals 15 come in contact with the device terminals 55 from the −Z direction to be electrically coupled to the device terminals 55. When the cartridge terminals 15 and the device terminals 55 are electrically coupled to each other, the printing device 200 can retrieve information regarding the cartridge 10 from the chip in the cartridge, for example. The information regarding the cartridge 10 includes information about a color of ink in the cartridge 10 and information about the ink level. The device terminal holder 60 is described in detail later.

As illustrated in FIG. 3, the cartridge 10 includes a case 11, the multiple cartridge terminals 15, and a cartridge terminal mounting portion 20. The case 11 is a container containing ink as a print material. The cartridge terminals 15 are terminals electrically coupled to the device terminals 55. The cartridge terminal mounting portion 20 has the cartridge terminals 15 thereon. In FIG. 3, although four cartridge terminals 15 are illustrated, the number of the cartridge terminals 15 is not limited to four. Furthermore, in FIG. 3, the cartridge terminals 15 are arranged to be vertexes of a rectangle, but the arrangement of the cartridge terminals 15 is not limited to this. The number and the arrangement of the device terminals 55 of the installation portion 290 only need to be the same as those of the cartridge terminals 15.

The case 11 of this embodiment includes a case body 12 having a substantially cylindrical shape and a protrusion 13 having a substantially cylindrical shape and a radius smaller than that of the case body 12. The protrusion 13 is continuous with one of two bases of the case body 12, and the inside of the case body 12 and the inside of the protrusion 13 are in communication with each other. The protrusion 13 has an ink outlet (not illustrated). When the cartridge 10 is attached to the installation portion 290, the above-described supply tube 292 is inserted into the ink outlet. The ink in the case 11 is supplied to the printing device 200 through the ink outlet and the supply tube 292.

The cartridge terminal mounting portion 20 is disposed on the case 11. In this embodiment, the cartridge terminal mounting portion 20 is disposed on a side surface of the protrusion 13 of the case 11. In FIG. 3, the cartridge terminals 15 on the cartridge terminal mounting portion 20 face in the +X direction. The cartridge terminal mounting portion 20 is described in detail later.

Figure 4:
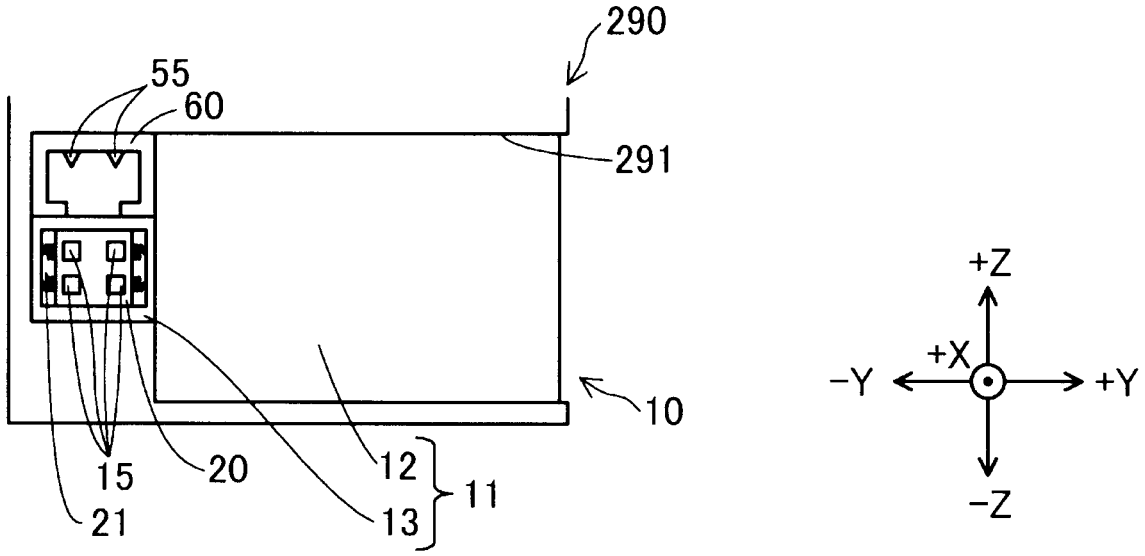
FIG. 4 is an explanatory view illustrating the cartridge in the installation portion.
Figure 5:
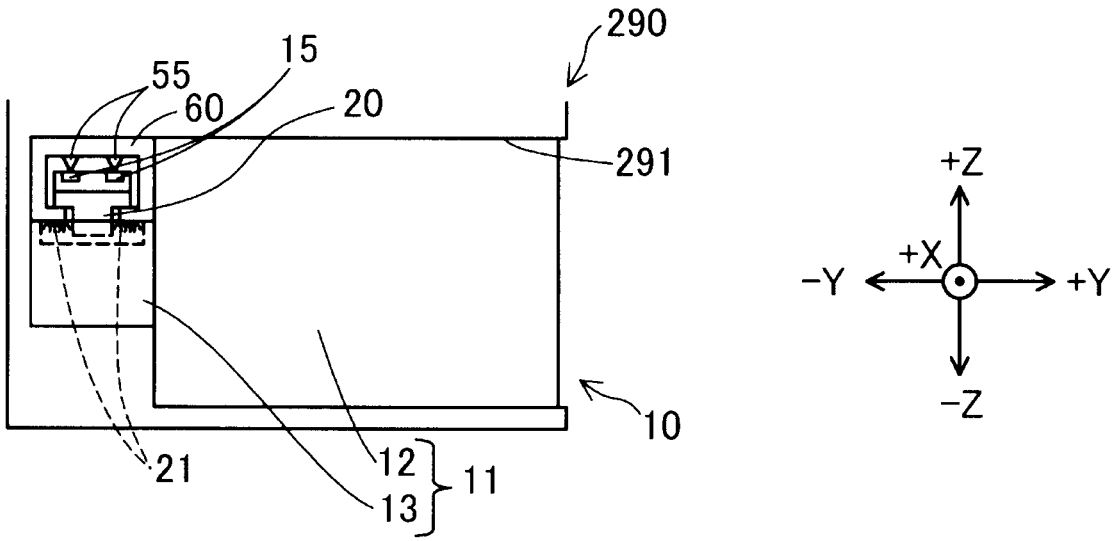
FIG. 5 is an explanatory view illustrating device terminals and cartridge terminals electrically coupled to each other.

FIG. 4 is an explanatory view illustrating the cartridge 10 inserted into the installation portion 290. FIG. 5 is an explanatory view illustrating the device terminals 55 and the cartridge terminals 15 electrically coupled to each other. In FIG. 5, a broken line indicates a portion invisible from the outside. When the cartridge 10 is installed in the printing device, as illustrated in FIGS. 3 and 4, the cartridge 10 is moved in the −Y direction to be inserted into the installation portion 290. Then, as illustrated in FIGS. 4 and 5, the cartridge 10 is rotated in a direction intersecting with the Y direction and thus the device terminals 55 and the cartridge terminals 15 are in contact with each other and electrically coupled to each other. In this embodiment, the rotation direction in which the cartridge 10 is rotated is a clockwise direction with respect to the −Y direction, which is an insertion direction. A radial direction of rotation of the cartridge 10 may be referred to as a "rotation radial direction". The rotation radial direction includes opposite directions along the same axis. In other words, the rotation radial direction includes both a direction toward the rotation axis and a direction away from the rotation axis. Furthermore, herein, a state in which "the cartridge 10 is attached to the installation portion 290" indicates a state in which the cartridge 10 is inserted into the installation portion 290 with the device terminals 55 and the cartridge terminals 15 being electrically coupled to each other. This state may be referred to as an installed state in which the "cartridge 10 is being installed in the printing device 200". Furthermore, the process of inserting the cartridge 10 into the printing device 200 may be referred to as an installation process. In the installation process and the installed state, the cartridge terminal mounting portion 20 and the device terminal holder 60 are in contact with each other. The positional relationship between the cartridge terminal mounting portion 20 and the device terminal holder 60 in the installation process and the installed state is described in detail later.

The cartridge 10 or the installation portion 290 may have a guide that assists the insertion of the cartridge 10 and the rotation of the cartridge 10. For example, the cartridge 10 may have a protrusion extending in the axial direction of the case 11 on the side surface of the case 11, and the installation portion 290 may have a groove engageable with the protrusion. The groove extends in the Y direction on the inner circumference of the installation hole 291. Alternatively, the side surface of the case 11 may have a groove extending in the rotation direction or a groove extending in a direction intersecting with the insertion direction and the rotation direction, and the inner circumferential surface of the installation hole 291 may have a guide pin, which tracks the groove.

Figure 6:
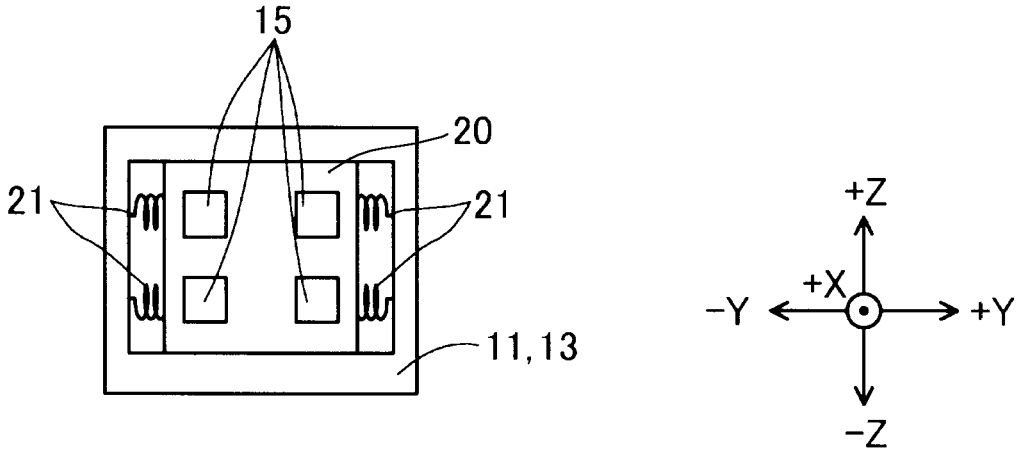
FIG. 6 is an explanatory view illustrating a protrusion of a case.

FIG. 6 is an explanatory view illustrating the protrusion 13 of the case 11. The cartridge terminals 15 are disposed on the cartridge terminal mounting portion 20 in a movable manner in the Y direction and the rotation radial direction relative to the case 11. Specifically described, in this embodiment, the cartridge terminal mounting portion 20 is fastened to the protrusion 13 by springs 21. In this embodiment, the cartridge terminal mounting portion 20 is sandwiched between the four springs 21 in the Y direction. Furthermore, as illustrated in FIG. 6, the cartridge terminal mounting portion 20 is positioned away from the protrusion 13 in the rotation radial direction. Thus, due to expansion and contraction of the springs 21, the cartridge terminal mounting portion 20 is movable relative to the case 11 in the Y direction and the rotation radial direction. The cartridge terminals 15 on the cartridge terminal mounting portion 20 are movable relative to the case 11 in the Y direction and the rotation radial direction. In FIG. 6, the cartridge terminals 15 are movable relative to the case 11 in the Y direction and the Z direction. The number of springs 21 that fasten the cartridge terminal mounting portion 20 is not limited to four. Furthermore, the spring 21 may be a leaf spring, a helical spring, or another elastic member.

Figure 7:
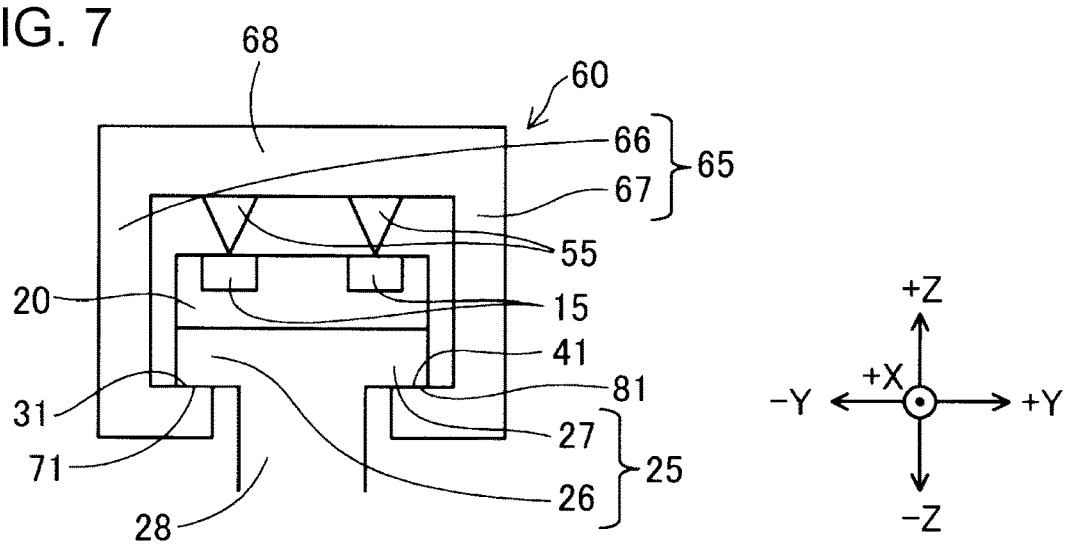
FIG. 7 is an explanatory view indicating the positional relationship between a cartridge terminal mounting portion and a device terminal holder in an installed state according to a first embodiment.

FIG. 7 is an explanatory view indicating the positional relationship between the cartridge terminal mounting portion 20 and the device terminal holder 60 in the installed state. As illustrated in FIG. 7, the cartridge terminal mounting portion 20 has a restricting portion 25. The restricting portion 25 restricts the movement of the cartridge terminals 15 in the Y direction and the Z direction in the installation process. The restricting portion 25 includes a first restricting portion 26 at the end in the −Y direction of the cartridge terminal mounting portion 20 and a second restricting portion 27 at the end in the +Y direction of the cartridge terminal mounting portion 20. Furthermore, in this embodiment, the cartridge terminal mounting portion 20 includes a base 28 continuous with the first and second restricting portions 26 and 27. In this embodiment, the above-described four springs 21 are attached to the base 28. In FIG. 7, the springs 21 are not illustrated.

The device terminal holder 60 has a positioning portion 65. The positioning portion 65 restricts the movement of the cartridge terminals 15 in the Y direction and the Z direction in the installation process. The positioning portion 65 includes a first positioning portion 66 at the end in the Y direction of the device terminal holder 60 and a second positioning portion 67 at the other end in the Y direction of the device terminal holder 60. The first restricting portion 26 comes in contact with the first positioning portion 66 in the installation process. The second restricting portion 27 comes in contact with the second positioning portion 67 in the installation process. Furthermore, in this embodiment, the device terminal holder 60 includes a support 68 continuous with the first and second positioning portions 66 and 67. In this embodiment, the device terminals 55 are on the support 68.

In this embodiment, the base 28 has a plate-like shape. The first restricting portion 26 is a protrusion extending in the −Y direction from the base 28. The second restricting portion 27 is a protrusion extending in the +Y direction from the base 28.

In this embodiment, the support 68 has a plate-like shape. The first and second positioning portions 66 and 67 are protrusions extending in the −Z direction from the support 68. In this embodiment, the first positioning portion 66 is located at the end in the −Y direction of the device terminal holder 60 and the second positioning portion 67 is located at the end in the +Y direction of the device terminal holder 60. In this embodiment, the device terminal holder 60 has an opening defined by the support 68 and the positioning portion 65 and opens in the X direction and the −Z direction.

In the installed state, the first and second restricting portions 26 and 27 face the respective first and second positioning portions 66 and 67. Specifically described, the first restricting portion 26 extending from the base 28 in the −Y direction faces the first positioning portion 66 and the second restricting portion 27 extending from the base 28 in the +Y direction faces the second positioning portion 67.

The first restricting portion 26 and the second restricting portion 27 of this embodiment have Z restriction surfaces, which are in contact with corresponding Z positioning surfaces of the first and second positioning portions 66 and 67 during the installed state. Specifically described, the first restricting portion 26 has a first Z restriction surface 31 at the end in the −Z direction of the first restricting portion 26. The second restricting portion 27 has a second Z restriction surface 41 at the end in the −Z direction of the second restricting portion 27. The first Z restriction surface 31 is a surface of the first restricting portion 26 facing in the −Z direction during the installed state. The second Z restriction surface 41 is a surface of the second restricting portion 27 facing in the −Z direction during the installed state. The contact between the restricting portion 25 and the positioning portion 65 may take place at a surface, a line, or a point. The contact surfaces of the restricting portion 25 and the positioning portion 65 are not limited to even surfaces and may be surfaces with grooves or recesses or surfaces with bumps or protrusions.

The first and second positioning portions 66 and 67 each have a Z positioning surface. Specifically described, the first positioning portion 66 has a first Z positioning surface 71. The second positioning portion 67 has a second Z positioning surface 81. In this embodiment, the first positioning portion 66 has a portion protruding in the +Y direction at the end in the −Z direction of the first positioning portion 66, and the portion protruding in the +Y direction has the first Z positioning surface 71 facing in the +Z direction. The second positioning portion 67 has a portion protruding in the −Y direction at the end in the −Z direction of the second positioning portion 67, and the protrusion extending in the −Y direction has the second Z positioning surface 81 facing in the +Z direction. In this embodiment, the first Z restriction surface 31 is in contact with the first Z positioning surface 71 during the installed state. The second Z restriction surface 41 is in contact with the second Z positioning surface 81 during the installed state.

As described above, the cartridge terminal mounting portion 20 and the device terminal holder 60 are in contact with each other in the installation process and the installed state. In this embodiment, the cartridge 10 in FIG. 4 starts to rotate relative to the installation portion 290. In the process of rotation, the cartridge terminal mounting portion 20 is guided into the device terminal holder 60 along the opening of the device terminal holder 60. Then, the cartridge 10 keeps rotating while the restricting portion 25 is restricting the movement of the cartridge terminals in the Y direction and the Z direction until the cartridge terminals 15 and the device terminals 55 are electrically coupled to each other as illustrated in FIG. 5. In this embodiment, the first Z restriction surface 31 is in contact with the first Z positioning surface 71 and the second Z restriction surface 41 is in contact with the second Z positioning surface 81 in the installation process and the installed state.

The cartridge terminals 15 movable in the Y direction and the rotation radial direction and the presence of the restricting portion 25 in contact with the positioning portion 65 in the installation process improve the accuracy of coupling positions between the cartridge terminals 15 and the device terminals 55. For example, in the installed state, the cartridge 10 may be moved relative to the installation portion 290 by impact on the printing device 200. In such a case, the cartridge terminals 15 and the device terminals 55 are more likely to keep in contact with each other due to expansion and contraction of the springs 21, which fastens the cartridge terminal mounting portion 20 to the protrusion 13, and due to the contact between the positioning portion 65 and the restricting portion 25. Furthermore, the improvement in accuracy of contact positions reduces poor electrical coupling between the cartridge terminals 15 and the device terminals 55.

The above-described cartridge of the present embodiment includes the cartridge terminal mounting portion 20 on which the cartridge terminals 15 are disposed in a movable manner in the Y direction and the rotation radial direction relative to the case 11. Furthermore, the cartridge terminal mounting portion 20 has the restricting portion 25 that restricts the movement of the cartridge terminals 15 in the Y direction and the Z direction in the installation process. This configuration improves the accuracy of coupling positions between the cartridge terminals 15 and the device terminals 55, although the cartridge 10 is movable relative to the printing device 200 in the Y direction and the intersecting direction.

Furthermore, in this embodiment, the first restricting portion 26 is a protrusion extending in the −Y direction from the base 28 and the second restricting portion 27 is a protrusion extending in the +Y direction from the base 28. Furthermore, in the installed state, the first and second restricting portions 26 and 27 face the respective first and second positioning portions 66 and 67. This simple configuration restricts the movement of the cartridge terminals 15 in the Y direction and the Z direction. This improves the accuracy of coupling positions between the cartridge terminals 15 and the device terminals 55.

Furthermore, in this embodiment, the first restricting portion 26 and the second restricting portion 27 have the Z restriction surfaces being in contact with the corresponding Z positioning surfaces of the first and second positioning portion 66 and 67 during the installed state. This further restricts the movement of the cartridge terminals 15 in the Z direction relative to the device terminals 55 in the installed state. This improves the accuracy of coupling positions between the cartridge terminals 15 and the device terminals 55.

B. Second Embodiment

Figure 8:
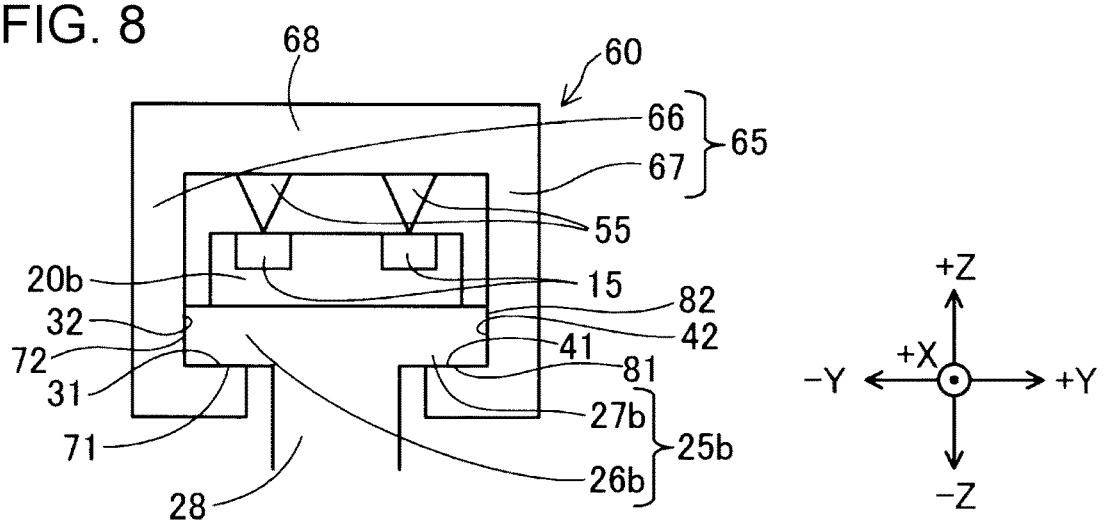
FIG. 8 is an explanatory view indicating the positional relationship between a cartridge terminal mounting portion and a device terminal holder in an installed state according to a second embodiment.

FIG. 8 is an explanatory view indicating a positional relationship between a cartridge terminal mounting portion 20*b* and the device terminal holder 60 in the installed state according to a second embodiment. In this embodiment, a restricting portion 25*b* has a different configuration from the restricting portion 25 in the first embodiment. The other components of the multi-function device 100 and the cartridge 10 have the same configurations as those in the first embodiment unless otherwise described.

The restricting portion 25*b* includes a first restricting portion 26*b* and a second restricting portion 27*b*. The first restricting portion 26*b* has a first Y restriction surface 32 facing in the −Y direction. In the installed state, the first Y restriction surface 32 is in contact with a first Y positioning surface 72 of the first positioning portion 66 facing in the +Y direction. The second restricting portion 27*b* has a second Y restriction surface 42 facing in the +Y direction. In the installed state, the second Y restriction surface 42 is in contact with a second Y positioning surface 82 of the second positioning portion 67 facing in the −Y direction. Thus, in this embodiment, the first Y restriction surface 32 is in contact with the first Y positioning surface 72 both in the installation process and the installed state. The second Y restriction surface 42 is in contact with the second Y positioning surface 82 both in the installation process and the installed state. In this embodiment, as in the first embodiment, the first Z restriction surface 31 and the first Z positioning surface 71 are in contact with each other and the second Z restriction surface 41 and the second Z positioning surface 81 are in contact with each other in both the installation process and the installed state.

The above-described cartridge according to the second embodiment also improves the accuracy of coupling positions between the cartridge terminals 15 and the device terminals 55. In particular, in this embodiment, the movement of the cartridge terminals 15 in the Y direction relative to the device terminals 55 in the installed state is more restricted.

C. Third Embodiment

Figure 9:
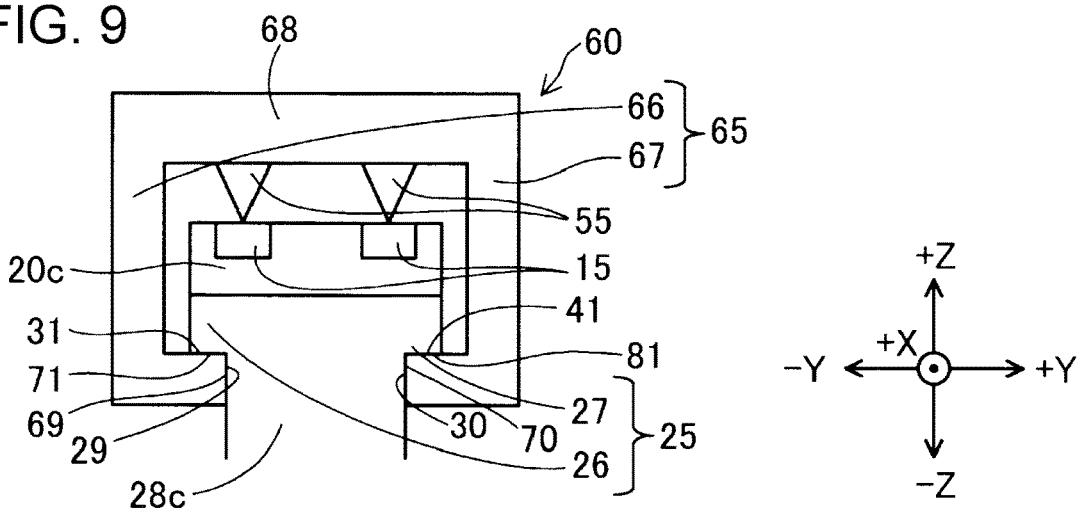
FIG. 9 is an explanatory view indicating the positional relationship between a cartridge terminal mounting portion and a device terminal holder in an installed state according to a third embodiment.

FIG. 9 is an explanatory view indicating a positional relationship between a cartridge terminal mounting portion 20*c* and the device terminal holder 60 in the installed state according to a third embodiment. In this embodiment, a base 28*c* has a different configuration from the base 28 in the first embodiment. The other components of the multi-function device 100 and the cartridge 10 have the same configurations as those in the first embodiment unless otherwise described.

The base 28*c* of this embodiment has a −Y contact surface 29 facing in the −Y direction and a +Y contact surface 30 facing in the +Y direction. In the installed state, the −Y contact surface 29 is in contact with a first base contact surface 69 of the first positioning portion 66 facing in the +Y direction. In the installed state, the +Y contact surface 30 is in contact with a second base contact surface 70 of the second positioning portion 67 facing in the −Y direction. In this embodiment, as in the first embodiment, the first Z restriction surface 31 is in contact with the first Z positioning surface 71 and the second Z restriction surface 41 is in contact with the second Z positioning surface 81 in both the installation process and the installed state.

The above-described cartridge according to the third embodiment also improves the accuracy of coupling positions between the cartridge terminals 15 and the device terminals 55. In particular, in this embodiment, the movement of the cartridge terminals 15 in the Y direction relative to the device terminals 55 in the installed state is more restricted.

D. Fourth Embodiment

Figure 10:
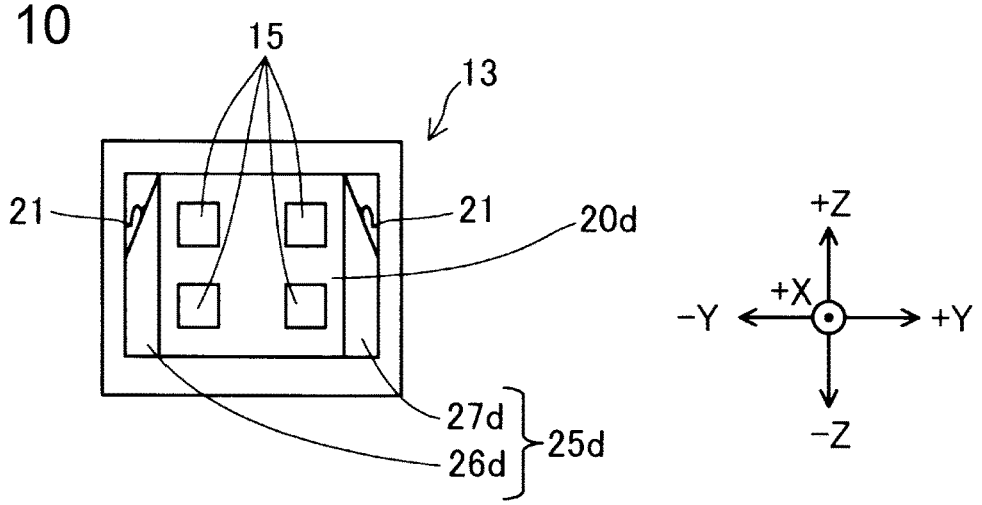
FIG. 10 is a schematic explanatory view illustrating a protrusion according to a fourth embodiment.

FIG. 10 is a schematic explanatory view illustrating a configuration of a protrusion 13 according to a fourth embodiment. The other components of the multi-function device 100 and the cartridge 10 have the same configurations as those in the first embodiment unless otherwise described.

As illustrated in FIG. 10, a cartridge terminal mounting portion 20*d* on the protrusion 13 is at least partly tapered such that the restricting portion 25*d* has a dimension in the Y direction monotonically decreasing toward a forward end in the rotation direction. In this embodiment, each of the first restricting portion 26*d* and the second restricting portion 27*d* has a portion monotonically decreasing in dimension in the Y direction toward the forward end in the rotation direction. In FIG. 10, the rotation direction corresponds to the +Z direction.

The above-described cartridge according to the fourth embodiment improves the accuracy of coupling positions between the cartridge terminals 15 and the device terminals 55. In particular, this embodiment reduces damage caused by collision between the cartridge terminal mounting portion 20 and the device terminal holder 60 in the installation process.

E. Fifth Embodiment

Figure 11:
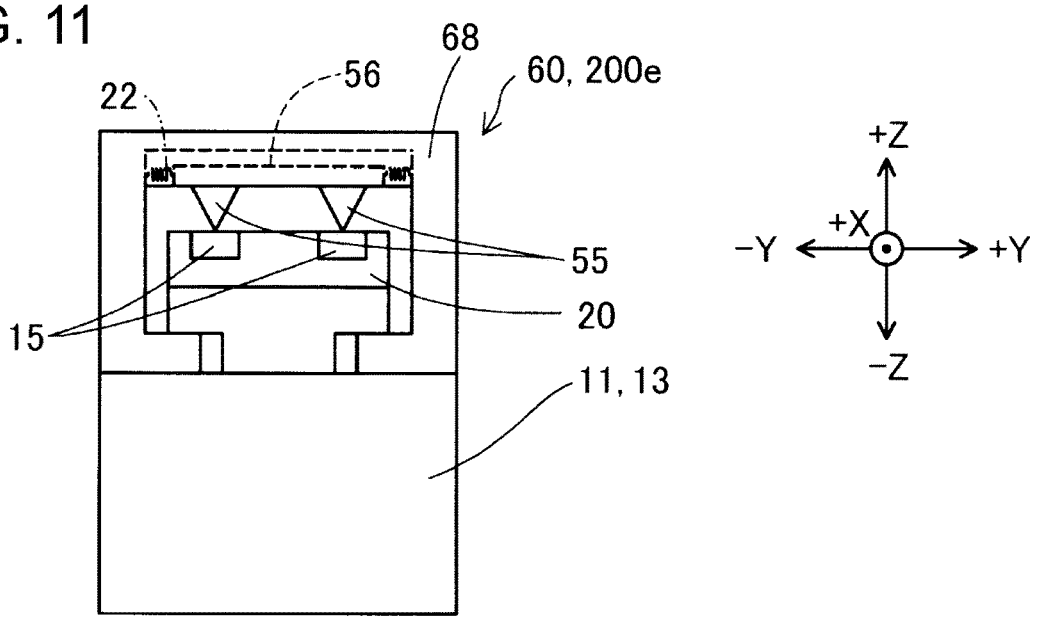
FIG. 11 is a schematic explanatory view illustrating a device terminal holder and a protrusion according to a fifth embodiment.

FIG. 11 is a schematic explanatory view illustrating a device terminal holder 60 of a printing device 200*e* and a protrusion 13 of a case 11 according to a fifth embodiment. In FIG. 11, a broken line indicates a portion invisible from the outside. The device terminal holder 60 of this embodiment holds the device terminals 55 in a movable manner in the Y direction and the Z direction unlike that of the first embodiment. Furthermore, the cartridge terminals 15 are not movable relative to the case 11. The other components of the multi-function device 100 and the cartridge 10 have the same configurations as those in the first embodiment unless otherwise described.

As illustrated in FIG. 11, a device terminal mounting portion 56 is fastened to the device terminal holder 60 of the fifth embodiment by springs 22. Specifically described, the device terminal mounting portion 56 is sandwiched between four springs 22 in the Y direction. In FIG. 11, two of the four springs 22 that are located at the +X direction side are illustrated. Multiple device terminals 55 are disposed on the device terminal mounting portion 56. The device terminal mounting portion 56 is away from the device terminal holder 60 in the Z direction. In this configuration, the device terminal mounting portion 56 is movable in the Y direction and the Z direction due to expansion and contraction of the springs. Accordingly, the device terminals 55 on the device terminal mounting portion 56 are also movable in the Y direction and the Z direction. In this embodiment, the device terminal mounting portion 56 is fixed to the support 68 of the device terminal holder 60. Furthermore, in this embodiment, the cartridge terminal mounting portion 20 is fixed to the protrusion 13 by an adhesive, not by the springs 21. Thus, the cartridge terminals 15 are not movable relative to the case 11. The other components of the printing device 200*e* and the cartridge 10 have the same configurations as those in the first embodiment. The number of springs 22 is not limited to four. Furthermore, the spring 22 may be a leaf spring, a helical spring, or another elastic member.

In this embodiment, the positional relationship between the cartridge terminal mounting portion 20 and the device terminal holder 60 in the installed state is the same as that in the first embodiment illustrated in FIG. 7. The presence of the device terminals 55 movable in the Y direction and Z direction and the presence of the restricting portion 25 in contact with the positioning portion 65 in the installation process reduce poor contact between the device terminals 55 and the cartridge terminals 15. For example, in the installed state, the cartridge 10 may be moved relative to the installation portion 290 by impact on the printing device 200. In such a case, the cartridge terminals 15 and the device terminals 55 are likely to keep in contact with each other due to expansion and contraction of the springs 22, which fasten the device terminal mounting portion 56 to the device terminal holder 60, and the contact between the positioning portion 65 and the restricting portion 25.

The above-described printing device 200*e* of this embodiment includes the device terminal holder 60 holding the device terminals 55 in a movable manner in the Y direction and the Z direction. Furthermore, the device terminal holder 60 includes the positioning portion 65 that restricts the movement of the cartridge terminals 15 in the Y direction and the Z direction in the installation process. Thus, the accuracy of the coupling positions between the cartridge terminals 15 and the device terminals 55 is improved although the cartridge 10 is movable in the Y direction and the intersecting direction relative to the printing device 200.

Furthermore, in this embodiment, the first and second positioning portions 66 and 67 are protrusions extending from the support 68 in the −Z direction, and the first and second positioning portions 66 and 67 face the respective first and second restricting portions 26 and 27 during the installed state. This simple configuration restricts the movement of the cartridge terminals 15 in the Y direction and the Z direction during the installation process. Thus, the accuracy of the coupling positions between the cartridge terminals 15 and the device terminals 55 is improved.

Furthermore, in this embodiment, the first and second positioning portion 66 and 67 have the Z positioning surfaces facing in the +Z direction and being in contact with the corresponding Z restriction surfaces of the first restricting portion 26 and the second restricting portion 27 during the installed state. This further restricts the movement of the cartridge terminals 15 in the Z direction relative to the device terminals 55 during the installed state. Thus, the accuracy of coupling positions between the cartridge terminals 15 and the device terminals 55 is improved.

F. Sixth Embodiment

The device terminal holder 60 according to this embodiment has the same configuration as that according to the fifth embodiment illustrated in FIG. 11. Specifically described, the device terminal holder 60 according to this embodiment holds the device terminals 55 in a movable manner in the Y direction and the Z direction. Furthermore, the cartridge terminals 15 are not movable relative to the case 11. In this embodiment, the other components of the multi-function device 100 and the cartridge 10 have the same configurations as those in the second embodiment unless otherwise described. In this embodiment, the positional relationship between the cartridge terminal mounting portion 20 and the device terminal holder 60 in the installed state is the same as that in the second embodiment illustrated in FIG. 8.

The above-described printing device 200*e* according to the sixth embodiment improves the accuracy of the coupling positions between the cartridge terminals 15 and the device terminals 55. In particular, in this embodiment, the movement of the cartridge terminals 15 in the Y direction relative to the device terminals 55 in the installed state is more restricted.

G. Seventh Embodiment

Figure 12:
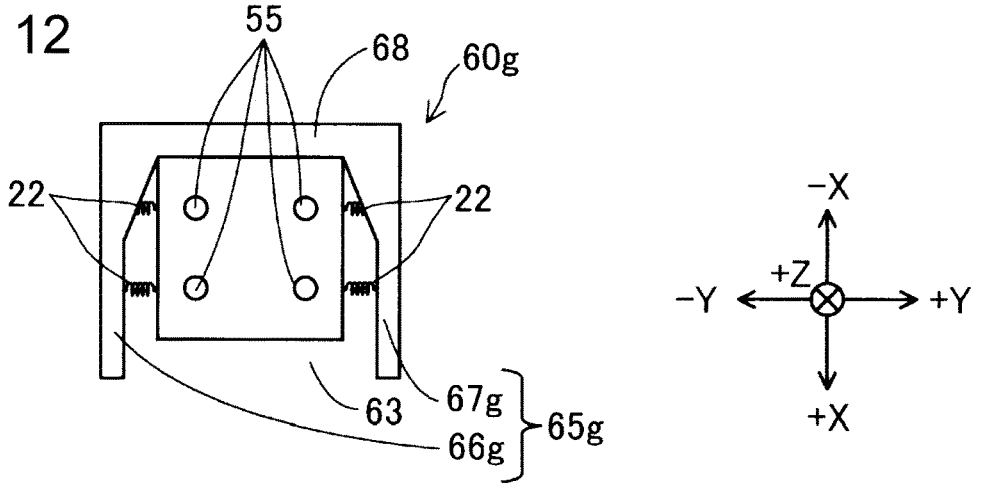
FIG. 12 is a schematic explanatory view illustrating a device terminal holder according to a seventh embodiment.

FIG. 12 is a schematic explanatory view illustrating a device terminal holder 60*g* according to a seventh embodiment. The device terminal holder 60*g* of this embodiment holds the device terminals 55 in a movable manner in the Y direction and the Z direction. Furthermore, the cartridge terminals 15 are not movable relative to the case 11. In this embodiment, the other components of the multi-function device 100 and the cartridge 10 have the same configurations as those in the first embodiment unless otherwise described.

As illustrated in FIG. 12, as the first embodiment illustrated in FIG. 7, the device terminal holder 60*g* has an opening defined by the support 68 and a positioning portion 65*g*. The opening faces in the Z direction and the +X direction. Specifically described, the opening 63 is located between a first positioning portion 66*g* located at the end in the −Y direction of the device terminal holder 60*g* and a second positioning portion 67*g* located at the end in the +Y direction of the device terminal holder 60*g*. The opening 63 receives the rotating first and second restricting portions 26 and 27 in the installation process.

The positioning portion 65*g* of this embodiment has at least a portion monotonically increasing in dimension in the Y direction toward the forward end in the rotation direction of the positioning portion 65*g*. Specifically described, the first positioning portion 66*g* has a portion monotonically increasing in dimension in the Y direction toward the forward end in the rotation direction, and the second positioning portion 67*g* has a portion monotonically increasing in dimension in the Y direction toward the forward end in the rotation direction. In this configuration, the opening 63 defined between the first positioning portion 66*g* and the second positioning portion 67*g* has a dimension in the Y direction monotonically decreasing at a portion in the rotation direction. In FIG. 12, the rotation direction corresponds to the −X direction.

In this embodiment, the cartridge terminal mounting portion 20 may have a shape matching with the shape of the device terminal holder 60*g*. Specifically described, as the restricting portion 25*d* according to the fourth embodiment illustrated in FIG. 10, the restricting portion 25 may have a portion monotonically decreasing in dimension in the Y direction toward the forward end in the rotation direction such that the restricting portion 25 has a shape matching with the shape of the positioning portion 65*g*. In particular, the restricting portion 25 and the positioning portion 65*g* may be shaped to fit together in the installed state.

The above-described printing device 200*e* according to the seventh embodiment improves the accuracy of coupling positions between the cartridge terminals 15 and the device terminals 55. In particular, this embodiment reduces damage caused by collision between the device terminal holder 60*g* and the cartridge terminal mounting portion 20 in the installation process.

H. Eighth Embodiment

Figure 13:
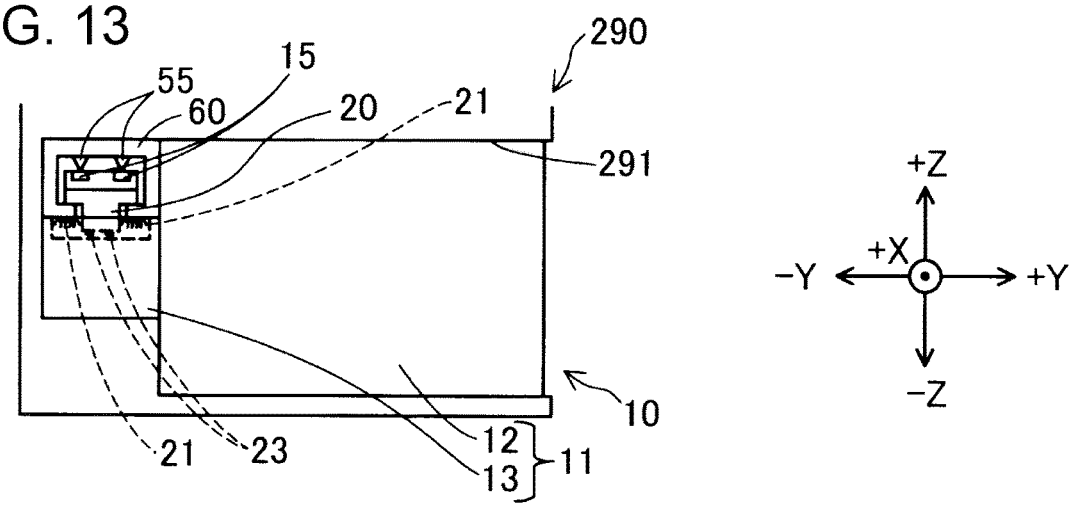
FIG. 13 is an explanatory view illustrating a cartridge according to an eighth embodiment.

FIG. 13 is an explanatory view illustrating a configuration of a cartridge 10 according to an eighth embodiment. In FIG. 13, a broken line indicates a portion invisible from the outside. In the eighth embodiment, the cartridge terminal mounting portion 20 is fastened to the protrusion 13 by springs 23 in the rotation radial direction.

In this configuration, the cartridge terminals 15 are movable relative to the case 11 in the Y direction and the rotation radial direction due to expansion and contraction of the springs 23. Thus, as in the first embodiment, the accuracy of the coupling positions between the cartridge terminals 15 and the device terminals 55 is improved. For example, the cartridge terminals 15 may be fastened to the case 11 only by the springs 23. In such a case, the cartridge terminals 15 are movable relative to the case 11 in the Y direction and the rotation radial direction due to expansion and contraction of the springs 23.

I. Ninth Embodiment

Figure 14:
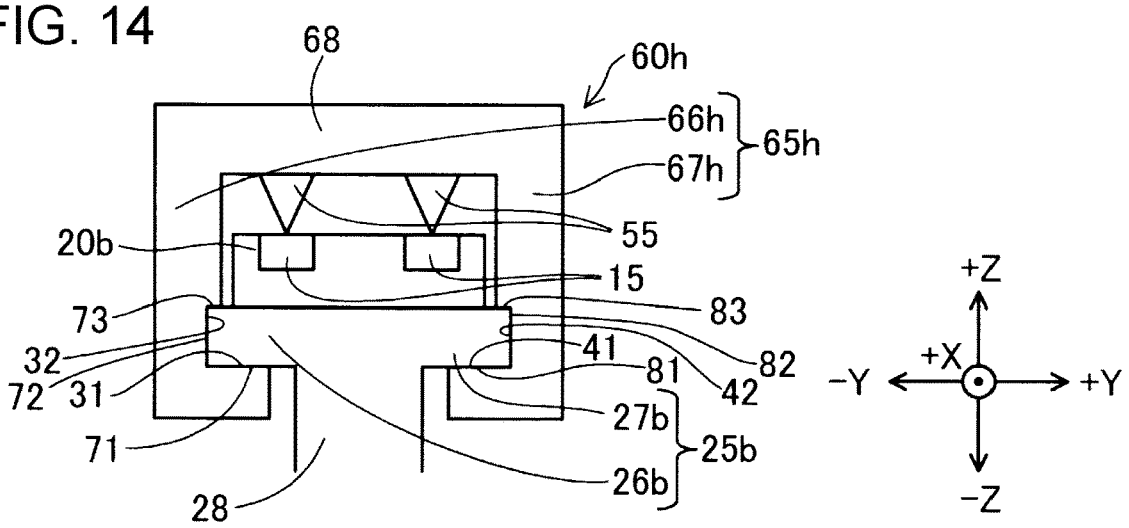
FIG. 14 is a schematic explanatory view illustrating a device terminal holder according to a ninth embodiment.

FIG. 14 is a schematic explanatory view illustrating a device terminal holder 60*h* according to a ninth embodiment. The device terminal holder 60*h* of this embodiment has a positioning portion 65*h* having a different configuration from the device terminal holder 60 in the first embodiment. Specifically described, a first positioning portion 66*h* has a first surface 73 in contact with a surface of a first restricting portion 26*b* facing in the +Z direction and a second positioning portion 67*h* has a second surface 83 in contact with a surface of a second restricting portion 27*b* facing in the +Z direction.

In this configuration, movement of the cartridge terminals 15 in the +Z direction is restricted in the installation process. Thus, the accuracy of the coupling positions between the cartridge terminals 15 and the device terminals 55 is improved.

J. Tenth Embodiment

Figure 15:
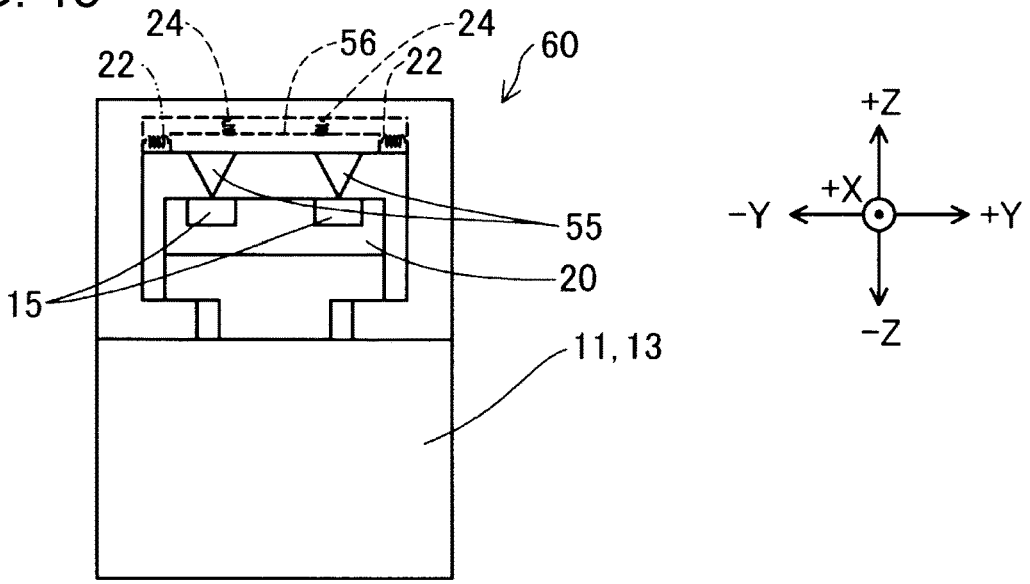
FIG. 15 is a schematic explanatory view illustrating a device terminal holder according to a tenth embodiment.

FIG. 15 is a schematic explanatory view illustrating a device terminal holder 60 according to a tenth embodiment. In FIG. 15, a broken line indicates a portion invisible from the outside. In this embodiment, the device terminal mounting portion 56 is fastened to the device terminal holder 60 by springs 24 in the Z direction.

In this configuration, the device terminals 55 are movable in the Y direction and the Z direction due to expansion and contraction of the springs 24. Thus, as in the fifth embodiment, the accuracy of coupling positions between the cartridge terminals 15 and the device terminals 55 is improved. For example, the device terminal mounting portion 56 may be fastened to the device terminal holder 60 only by the springs 24. In such a case, the device terminals 55 are movable in the Y direction and the Z direction due to expansion and contraction of the springs 24.

K. Other Embodiments (K-1) In the above-described embodiments, the case 11 includes the protrusion 13. However, the protrusion 13 may be eliminated from the case 11. In such a case, the cartridge terminal mounting portion 20 may be disposed on a component equivalent to the case body 12.

(K-2) In the above-described embodiments, the case 11 has a substantially cylindrical shape. However, the case 11 may have a shape other than the substantially cylindrical shape. For example, the shape of the case 11 may be a substantially quadrilateral prism, any polygonal prism other than the substantially quadrilateral prism, a substantially circular cone, or a polygonal pyramid. Furthermore, the shape of the installation hole 291 is not limited to the substantially cylindrical shape and may have any shape that is able to receive the cartridge 10.

(K-3) In the above-described embodiments, the first and second restricting portions 26 and 27 are protrusions extending from the base 28 in the −Y direction and +Y direction. However, the first and second restricting portions 26 and 27 are not limited to the protrusions. For example, the first and second positioning portions 66 and 67 each may have a projection and the first and second restricting portions 26 and 27 each may have a groove that engages with the projection.

(K-4) In the above-described embodiments, the cartridge terminal mounting portion 20 includes the base 28. However, the base 28 may be eliminated from the cartridge terminal mounting portion 20.

(K-5) In the above-described embodiments, the first and second restricting portions 26 and 27 have the Z restriction surfaces being in contact with the corresponding Z positioning surfaces of the first and second positioning portions 66 and 67 during the installed state. However, the Z restriction surface may be eliminated from any one of the first restricting portion 26 and the second restricting portion 27. Alternatively, the Z restriction surface may be eliminated from both the first and second restricting portions 26 and 27. In such a case, the first and second restricting portions 26 and 27 may have the first and second Y restriction surfaces 32 and 42 without the Z restriction surfaces.

(K-6) In the above-described embodiments, the first and second positioning portions 66 and 67 are protrusions extending from the support 68 in the −Z direction. However, the first and second positioning portions 66 and 67 are not limited to the protrusions. For example, the first and second positioning portions 66 and 67 may be configured to be sandwiched between the first and second restricting portions 26 and 27 in the Y direction in the installation process.

(K-7) In the above-described embodiments, the Z axis extends along the vertical line. However, the Z axis may extend along a line other than the vertical line. For example, a direction in which the cartridge terminals 15 and the device terminals 55 face each other in the installed state may be defined as the Z axis. In such a case, a direction from the cartridge terminals 15 toward the device terminals 55 may be referred to as the +Z direction, and a direction from the device terminals 55 toward the cartridge terminals 15 may be referred to as the −Z direction.

(K-8) In the above-described embodiments, the case 11 of the cartridge 10 contains ink as a print material. However, the print material in the case 11 is not limited to the ink. When the print material is not ink, the printing device 200 does not need to be an ink jet printing device and only needs to be a printing device that uses a print material contained in the case 11. For example, the case 11 may contain toners as the print material and the printing device 200 may transfer the toners onto a medium.

Figure 16:
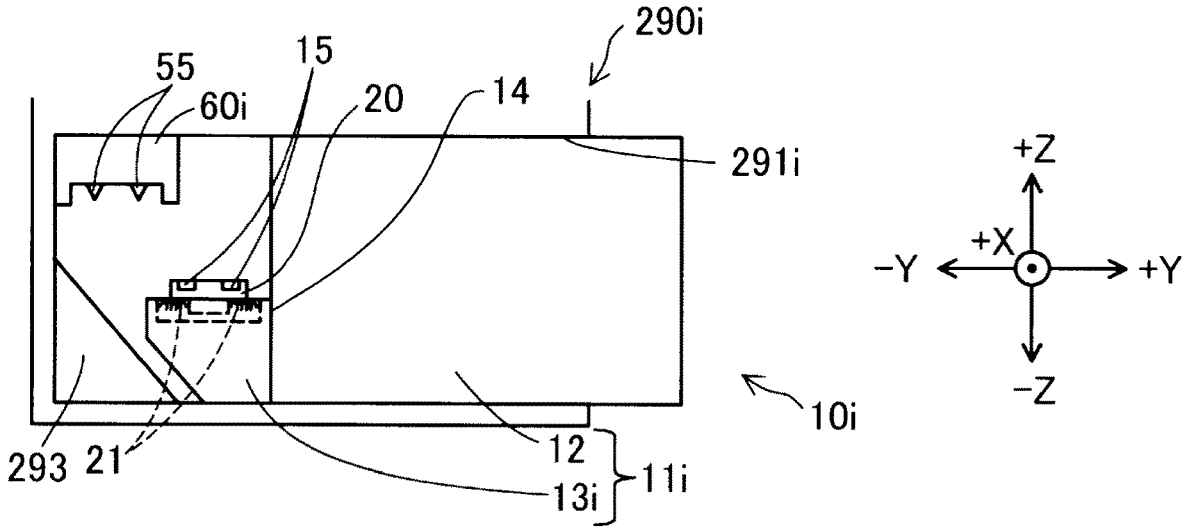
FIG. 16 is a schematic explanatory view illustrating an installation portion and a cartridge of a reference example.
Figure 17:
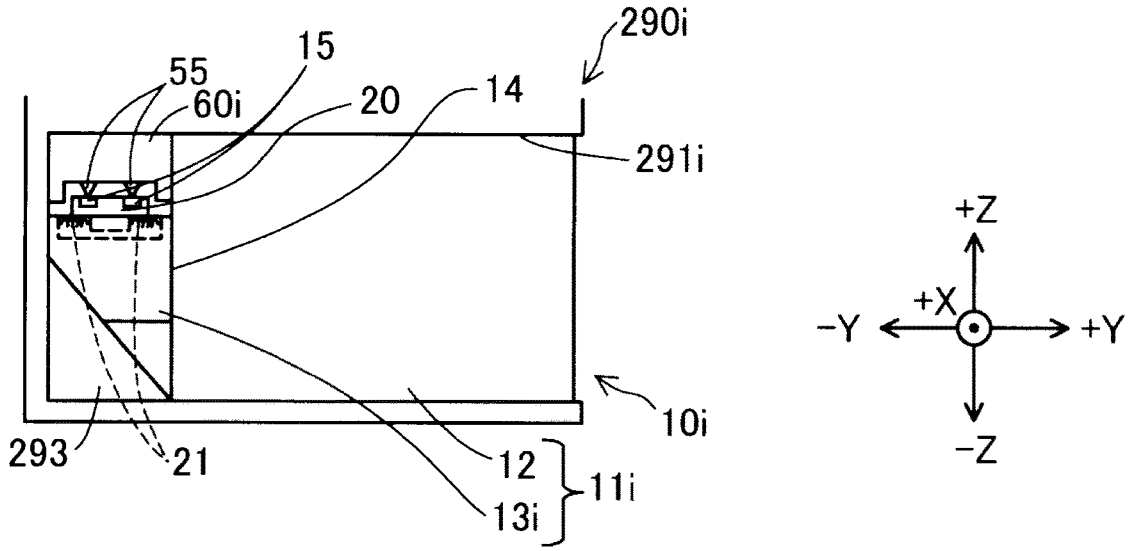
FIG. 17 is a schematic explanatory view illustrating an installation portion and a cartridge of a reference example.

L. Reference Examples (L-1) FIGS. 16 and 17 are schematic explanatory views illustrating a reference example including an installation portion 290*i* and a cartridge 10*i*. In FIGS. 16 and 17, a broken line indicates a portion invisible from the outside. FIG. 16 illustrates the cartridge 10*i* to be attached to the installation portion 290*i*. FIG. 17 illustrates the cartridge 10*i* being attached to the installation portion 290*i*. The cartridge 10*i* is inserted and attached to the installation portion 290*i* without being rotated, unlike the above-described embodiments. Specifically described, the cartridge 10*i* includes a first slider 14 that moves the protrusion 13*i* of the case 11*i* in a direction different from the insertion direction. More specifically described, the case body 12 has a rail-like groove extending in the Z direction in a surface facing in the −Y direction and the protrusion 13*i* has a projection that engages with the groove. A wall 293 is disposed at the end of the installation hole 291*i* in the insertion direction. When the cartridge 10*i* is inserted into the installation hole 291*i*, the protrusion 13*i* comes in contact with the wall 293. Then, when the cartridge 10*i* is further inserted into the installation hole 291*i*, the protrusion 13*i* slides in the +Z direction on the case body 12 due to the presence of the wall 293 and the first slider 14. Thus, the cartridge terminals 15 and the device terminals 55 are electrically coupled to each other. In other words, the cartridge terminals 15 are moved in the direction different from the insertion direction to be electrically coupled to the device terminals 55. As the cartridges of the first to fourth embodiments, the cartridge 10*i* of the reference example, in which the cartridge terminals 15 are movable relative to the case 11*i*, improves the accuracy of the contact positions between the device terminals 55 and the cartridge terminals 15. To obtain the above-described effect, the device terminals 55 may be made movable.

Figure 18:
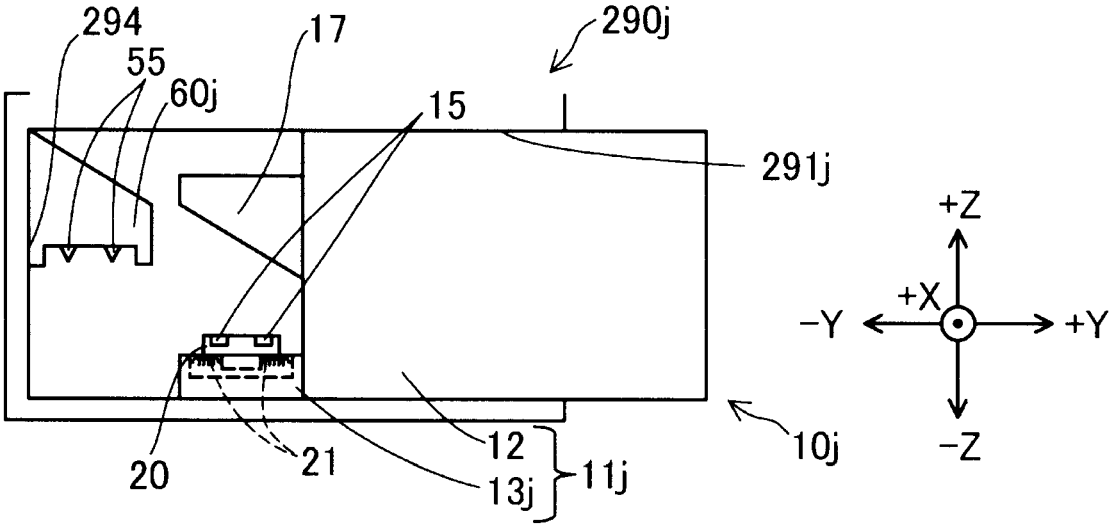
FIG. 18 is a schematic explanatory view illustrating an installation portion and a cartridge of a reference example.
Figure 19:
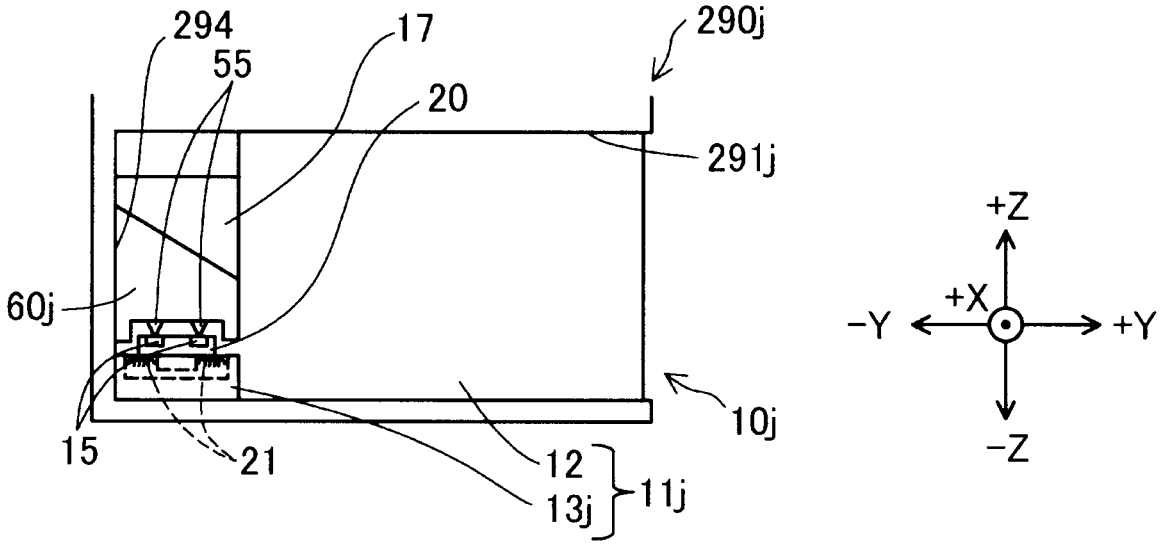
FIG. 19 is a schematic explanatory view illustrating an installation portion and a cartridge of a reference example.

(L-2) FIGS. 18 and 19 are schematic explanatory views illustrating a reference example including an installation portion 290*j* and a cartridge 10*j*. In FIGS. 18 and 19, a broken line indicates a portion invisible from the outside. FIG. 18 illustrates the cartridge 10*j* to be attached to the installation portion 290*j*. FIG. 19 illustrates the cartridge 10*j* being attached to the installation portion 290*j*. The cartridge 10*j* is inserted and attached to the installation portion 290*j* without being rotated, unlike the above-described embodiments. The installation hole 291*j* has a second slider 294 that moves the device terminal holder 60*j* in a direction different from the insertion direction. More specifically described, the second slider 294 has a rail-like groove extending in the Z direction and the device terminal holder 60*j* has a projection that engages with the groove. The cartridge 10*j* has a presser 17 at an end in the −Y direction. When the cartridge 10*i* is inserted into the installation hole 291*i*, the presser 17 comes in contact with the device terminal holder 60*j*. Then, when the cartridge 10*j* is further inserted into the installation hole 291*j*, the device terminal holder 60*j* slides in the −Z direction on the installation portion 290*j* due to the presence to the presser 17 and the second slider 294. Thus, the cartridge terminals 15 and the device terminals 55 are electrically coupled to each other. In other words, the device terminals 55 are moved in a direction different from the insertion direction to be electrically coupled to the cartridge terminals 15. As the cartridges in the first to fourth embodiments, the cartridge 10*j* of the reference example, in which the cartridge terminals 15 are movable relative to the case 11*j*, Improves the accuracy of the contact positions between the device terminals 55 and the cartridge terminals 15. To obtain the above-described effect, the device terminals 55 may be made movable.

M. Modifications

The present disclosure is not limited to the above-described embodiments, and the disclosure may be achieved in various forms without departing from the spirit of the disclosure. For example, the present disclosure may be achieved in the following forms. The technical characteristics of the above-described embodiments, which correspond to the technical characteristics of the following forms, may be replaced or combined as appropriate in order to at least partly solve the problems described above, or in order to at least partly achieve the effects described above. In addition, if there is a technical characteristic that is not described as essential herein, the technical characteristic may be omitted as appropriate.

(1) According to a first aspect of the present disclosure, a cartridge is provided. The cartridge is configured to be moved in a −Y direction and then rotated in an intersecting direction intersecting with a Y direction in order to be installed in a printing device that includes a plurality of device terminals and a device terminal holder holding the plurality of device terminals and having first and second positioning portions, in which three perpendicular spatial axes are X, Y, and Z axes, directions along the X, Y, and Z axes are, respectively, X, Y, and Z directions, positive directions along the X, Y, and Z axes are, respectively, +X, +Y, and +Z directions, and negative directions along the X, Y, and Z axes are, respectively, −X, −Y, and −Z directions. The cartridge includes a case containing a print material, a plurality of cartridge terminals configured to be electrically coupled to the plurality of device terminals, and a cartridge terminal mounting portion disposed on the case and having the plurality of cartridge terminals thereon. The plurality of cartridge terminals is configured to be moved relative to the case in the Y direction and a rotation radial direction of the rotation. The cartridge terminal mounting portion includes a restricting portion configured to restrict movement of the cartridge terminals in the Y direction and the Z direction during an installation process of installing the cartridge in the printing device. The restricting portion includes a first restricting portion located at an end in the −Y direction of the cartridge terminal mounting portion and configured to be in contact with the first positioning portion in the installation process and a second restricting portion located at an end in the +Y direction of the cartridge terminal mounting portion and configured to be in contact with the second positioning portion in the installation process. In this configuration, although the cartridge is movable relative to the printing device in the Y direction and the intersecting direction, the accuracy of coupling positions between the cartridge terminals and the device terminals is improved.

(2) In the cartridge according to the above-described aspect, the cartridge terminal mounting portion may include a base continuous with the first restricting portion and the second restricting portion, the first restricting portion may be a protrusion extending from the base in the −Y direction, the second restricting portion may be a protrusion extending from the base in the +Y direction, and the first restricting portion and the second restricting portion may face the respective first and second positioning portions during an installed state in which the cartridge is being installed in the printing device. In this configuration, the above-described simple structure restricts the movement of the cartridge terminals in the Y direction and the Z direction during the installation process. Thus, the accuracy of coupling positions between the cartridge terminals and the device terminals is improved.

(3) In the cartridge according to the above-described aspect, the first restricting portion and the second restricting portion may have Z restriction surfaces facing in the −Z direction and configured to be in contact with corresponding Z positioning surfaces of the first and second positioning portions facing in the +Z direction during the installed state. In this configuration, the movement of the cartridge terminals relative to the device terminals in the Z direction is more restricted during the installed state. Thus, the accuracy of coupling positions between the cartridge terminals and the device terminals is improved.

(4) In the cartridge according to the above-described aspect, the first restricting portion may have a first Y restriction surface facing in the −Y direction and configured to be in contact with a first Y positioning surface of the first positioning portion facing in the +Y direction during the installed state, and the second restricting portion may have a second Y restriction surface facing in the +Y direction and configured to be in contact with a second Y positioning surface of the second positioning portion facing in the −Y direction during the installed state. In this configuration, the movement of the cartridge terminals relative to the device terminals in the Y direction is more restricted during the installed state. Thus, the accuracy of coupling positions between the cartridge terminals and the device terminals is improved.

(5) In the cartridge according to the above-described aspect, the base may have a −Y contact surface facing in the −Y direction and being in contact with a surface of the first positioning portion facing in the +Y direction during the installed state and may have a +Y contact surface facing in the +Y direction and being in contact with a surface of the second positioning portion facing in the −Y direction during the installed state. In this configuration, the movement of the cartridge terminals relative to the device terminals in the Y direction is more restricted during the installed state. Thus, the accuracy of coupling positions between the cartridge terminals and the device terminals is improved.

(6) In the cartridge according to the above-described aspect, wherein the restricting portion is at least partly tapered to have a dimension in the Y direction monotonically decreasing toward a forward end of the restricting portion in a rotation direction of the rotation. This configuration reduces damage caused by collision between the cartridge terminal mounting portion and the device terminal holder in the installation process.

(7) According to a second aspect of the present disclosure, a printing device is provided. The printing device is configured to receive a cartridge that includes a plurality of cartridge terminals and a cartridge terminal mounting portion on which the plurality of cartridge terminals is disposed and having first and second restricting portions. The cartridge is configured to be moved in a −Y direction and then rotated in an intersecting direction intersecting with a Y direction in order to be installed in the printing device, in which three perpendicular spatial axes are X, Y, and Z axes, directions along the X, Y, and Z axes are, respectively, X, Y, and Z directions, positive directions along the X, Y, and Z axes are, respectively, +X, +Y, and +Z directions, and negative directions along the X, Y, and Z axes are, respectively, −X, −Y, and −Z directions. The printing device includes a plurality of device terminals configured to be electrically coupled to the plurality of cartridge terminals, and a device terminal holder holding the plurality of device terminals in a movable manner in the Y direction and the Z direction. The device terminal holder includes a positioning portion configured to restrict movement of the plurality of cartridge terminals in the Y direction and the Z direction during an installation process of installing the cartridge in the printing device. The positioning portion includes a first positioning portion located at an end in the −Y direction of the device terminal holder and configured to be in contact with the first restricting portion in the installation process and a second positioning portion located at an end in the +Y direction of the device terminal holder and configured to be in contact with the second restricting portion in the installation process. In this configuration, although the cartridge is movable relative to the printing device in the Y direction and the intersecting direction, the accuracy of coupling positions between the cartridge terminals and the device terminals is improved.

(8) In the printing device according to the above-described aspect, the device terminal holder may include a support continuous with the first positioning portion and the second positioning portion, the first positioning portion and the second positioning portion may be protrusions extending from the support in the −Z direction, and the first positioning portion and the second positioning portion may face the respective first and second restricting portions during an installed state in which the cartridge is being installed in the printing device. In this configuration, the above-described simple structure restricts the movement of the cartridge terminals in the Y direction and the Z direction during the installation process. Thus, the accuracy of coupling positions between the cartridge terminals and the device terminals is improved.

(9) In the printing device according to the above-described aspect, the first positioning portion and the second positioning portion may have Z positioning surfaces facing in the +Z direction and being in contact with corresponding Z restriction surfaces of the first and second restricting portions facing in the −Z direction during the installed state. In this configuration, the movement of the cartridge terminals relative to the device terminals in the Z direction is more restricted during the installed state. Thus, the accuracy of coupling positions between the cartridge terminals and the device terminals is improved.

(10) In the printing device according to the above-described aspect, the first positioning portion may have a first Y positioning surface facing in the +Y direction and configured to be in contact with a first Y restriction surface of the first restricting portion facing in the −Y direction during the installed state, and the second positioning portion may have a second Y positioning surface facing in the −Y direction and configured to be in contact with a second Y restriction surface of the second restricting portion facing in the +Y direction during the installed state. In this configuration, the movement of the cartridge terminals relative to the device terminals in the Y direction is more restricted during the installed state. Thus, the accuracy of coupling positions between the cartridge terminals and the device terminals is improved.

(11) In the printing device according to the above-described aspect, the first positioning portion and the second positioning portion may define an opening therebetween. The opening is configured to receive the first restricting portion and the second restricting portion rotating in the installation process. The positioning portion may have at least a portion monotonically increasing in dimension in the Y direction toward a forward end of the positioning portion in a rotation direction of the rotation. This configuration reduces damage caused by collision between the device terminal holder and the cartridge terminal mounting portion in the installation process.

The present disclosure is not limited to the above-described cartridge and the above-described printing device and may be embodied in various forms. For example, the present disclosure may be achieved in the form of a multifunction device having print functionality and read functionality.

What is claimed is:

1. A cartridge configured to be moved in a −Y direction and then rotated in an intersecting direction intersecting with a Y direction in order to be installed in a printing device that includes a plurality of device terminals and a device terminal holder holding the plurality of device terminals and having first and second positioning portions, in which three perpendicular spatial axes are X, Y, and Z axes, directions along the X, Y, and Z axes are, respectively, X, Y, and Z directions, positive directions along the X, Y, and Z axes are, respectively, +X, +Y, and +Z directions, and negative directions along the X, Y, and Z axes are, respectively, −X, −Y, and −Z directions, the cartridge comprising:

a case containing a print material;

a plurality of cartridge terminals configured to be electrically coupled to the plurality of device terminals; and a cartridge terminal mounting portion disposed on the case and having the plurality of cartridge terminals thereon, the plurality of cartridge terminals being configured to be moved relative to the case in the Y direction and a rotation radial direction of the rotation, wherein the cartridge terminal mounting portion includes a restricting portion configured to restrict movement of the cartridge terminals in the Y direction and the Z direction during an installation process of installing the cartridge in the printing device, and the restricting portion includes a first restricting portion located at an end in the −Y direction of the cartridge terminal mounting portion and configured to be in contact with the first positioning portion in the installation process and a second restricting portion located at an end in the +Y direction of the cartridge terminal mounting portion and configured to be in contact with the second positioning portion in the installation process.

2. The cartridge according to claim 1, wherein the cartridge terminal mounting portion includes a base continuous with the first restricting portion and the second restricting portion, the first restricting portion is a protrusion extending from the base in the −Y direction, the second restricting portion is a protrusion extending from the base in the +Y direction, and the first restricting portion and the second restricting portion face the respective first and second positioning portions during an installed state in which the cartridge is being installed in the printing device.

3. The cartridge according to claim 2, wherein the first restricting portion and the second restricting portion have Z restriction surfaces facing in the −Z direction and configured to be in contact with corresponding Z positioning surfaces of the first and second positioning portions facing in the +Z direction during the installed state.

4. The cartridge according to claim 2, wherein the first restricting portion has a first Y restriction surface facing in the −Y direction and configured to be in contact with a first Y positioning surface of the first positioning portion facing in the +Y direction during the installed state, and the second restricting portion has a second Y restriction surface facing in the +Y direction and configured to be in contact with a second Y positioning surface of the second positioning portion facing in the −Y direction during the installed state.

5. The cartridge according to claim 2, wherein the base has a −Y contact surface facing in the −Y direction and configured to be in contact with a surface of the first positioning portion facing in the +Y direction during the installed state and a +Y contact surface facing in the +Y direction and configured to be in contact with a surface of the second positioning portion facing in the −Y direction during the installed state.

6. The cartridge according to claim 1, wherein the restricting portion is at least partly tapered to have a dimension in the Y direction monotonically decreasing toward a forward end of the restricting portion in a rotation direction of the rotation.

7. A printing device configured to receive a cartridge that includes a plurality of cartridge terminals and a cartridge terminal mounting portion on which the plurality of cartridge terminals is disposed and having first and second restricting portions, the cartridge being configured to be moved in a −Y direction and then rotated in an intersecting direction intersecting with a Y direction in order to be installed in the printing device, in which three perpendicular spatial axes are X, Y, and Z axes, directions along the X, Y, and Z axes are, respectively, X, Y, and Z directions, positive directions along the X, Y, and Z axes are, respectively, +X, +Y, and +Z directions, and negative directions along the X, Y, and Z axes are, respectively, −X, −Y, and −Z directions, the printing device comprising:

a plurality of device terminals configured to be electrically coupled to the plurality of cartridge terminals; and a device terminal holder holding the plurality of device terminals in a movable manner in the Y direction and the Z direction, wherein the device terminal holder includes a positioning portion configured to restrict movement of the plurality of cartridge terminals in the Y direction and the Z direction during an installation process of installing the cartridge in the printing device, the positioning portion includes a first positioning portion located at an end in the −Y direction of the device terminal holder and configured to be in contact with the first restricting portion in the installation process and a second positioning portion located at an end in the +Y direction of the device terminal holder and configured to be in contact with the second restricting portion in the installation process, the first positioning portion and the second positioning portion define an opening therebetween, the opening being configured to receive the first restricting portion and the second restricting portion rotating in the installation process, and the positioning portion has at least a portion monotonically increasing in dimension in the Y direction toward a forward end of the positioning portion in a rotation direction of the rotation.

8. The printing device according to claim 7, wherein the device terminal holder includes a support continuous with the first positioning portion and the second positioning portion, the first positioning portion and the second positioning portion are protrusions extending from the support in the −Z direction, and the first positioning portion and the second positioning portion face the respective first and second restricting portions during an installed state in which the cartridge is being installed in the printing device.

9. The printing device according to claim 8, wherein the first positioning portion and the second positioning portion have Z positioning surfaces facing in the +Z direction and being in contact with corresponding Z restriction surfaces of the first and second restricting portions facing in the −Z direction during the installed state.

10. The printing device according to claim 8, wherein the first positioning portion has a first Y positioning surface facing in the +Y direction and configured to be in contact with a first Y restriction surface of the first restricting portion facing in the −Y direction during the installed state, and the second positioning portion has a second Y positioning surface facing in the −Y direction and configured to be in contact with a second Y restriction surface of the second restricting portion facing in the +Y direction during the installed state.

11. A printing device configured to receive a cartridge that includes a plurality of cartridge terminals and a cartridge terminal mounting portion on which the plurality of cartridge terminals is disposed and having first and second restricting portions, the cartridge being configured to be moved in a −Y direction and then rotated in an intersecting direction intersecting with a Y direction in order to be installed in the printing device, in which three perpendicular spatial axes are X, Y, and Z axes, directions along the X, Y, and Z axes are, respectively, X, Y, and Z directions, positive directions along the X, Y, and Z axes are, respectively, +X, +Y, and +Z directions, and negative directions along the X, Y, and Z axes are, respectively, −X, −Y, and −Z directions, the printing device comprising:

a plurality of device terminals configured to be electrically coupled to the plurality of cartridge terminals; and a device terminal holder holding the plurality of device terminals in a movable manner in the Y direction and the Z direction, wherein the device terminal holder includes a positioning portion configured to restrict movement of the plurality of cartridge terminals in the Y direction and the Z direction during an installation process of installing the cartridge in the printing device, the positioning portion includes a first positioning portion located at an end in the −Y direction of the device terminal holder and configured to be in contact with the first restricting portion in the installation process and a second positioning portion located at an end in the +Y direction of the device terminal holder and configured to be in contact with the second restricting portion in the installation process, the device terminal holder includes a support continuous with the first positioning portion and the second positioning portion, the first positioning portion and the second positioning portion are protrusions extending from the support in the −Z direction, the first positioning portion and the second positioning portion face the respective first and second restricting portions during an installed state in which the cartridge is being installed in the printing device, the first positioning portion has a first Y positioning surface facing in the +Y direction and configured to be in contact with a first Y restriction surface of the first restricting portion facing in the −Y direction during the installed state, and the second positioning portion has a second Y positioning surface facing in the −Y direction and configured to be in contact with a second Y restriction surface of the second restricting portion facing in the +Y direction during the installed state.

* * * * *